United States Patent [19]

Pichl

[11] 4,016,825

[45] Apr. 12, 1977

[54] DEVICE FOR DRIVING A BOAT PROPELLER AND COOLING WATER PUMP

[76] Inventor: Heinz Pichl, Bergfallsvagen 3, Uppsala 75256, Sweden

[22] Filed: Sept. 30, 1975

[21] Appl. No.: 618,130

[52] U.S. Cl. ..... 115/17; 74/404; 74/801

[51] Int. Cl.[2] ..... B63H 21/26

[58] Field of Search ..... 115/.5 HC, 17, 18 R, 115/34 R, 35; 123/41.47; 74/404, 801, 665 GA, 665 GB, DIG. 8; 415/64; 184/6; 259/105

[56] References Cited

UNITED STATES PATENTS

| | | | |
|---|---|---|---|
| 2,209,287 | 7/1940 | Simpson | 259/105 |
| 2,372,247 | 3/1945 | Billing | 115/35 |
| 2,496,434 | 2/1950 | Bosma | 184/6 |
| 2,616,386 | 11/1952 | Kiekaefer | 115/17 |
| 3,025,824 | 3/1962 | Foster | 115/17 |
| 3,094,967 | 6/1963 | Willis | 115/35 |
| 3,486,478 | 12/1969 | Halliday | 115/35 |

*Primary Examiner*—Trygve M. Blix
*Assistant Examiner*—Charles E. Frankfort
*Attorney, Agent, or Firm*—George H. Baldwin; Arthur G. Yeager

[57] ABSTRACT

A device for powering a propeller and a cooling water pump by a boat engine via a downwardly directed drive leg, which supports a hollow intermediate shaft for driving the propeller shaft. Between the crankshaft and the intermediate shaft there is arranged a reversible gear device. A shaft for powering the cooling water pump impeller is rigidly attached to the engine crankshaft and rotatably passes through the intermediate shaft to the impeller.

15 Claims, 5 Drawing Figures

DEVICE FOR DRIVING A BOAT PROPELLER AND COOLING WATER PUMP

Figure 1:
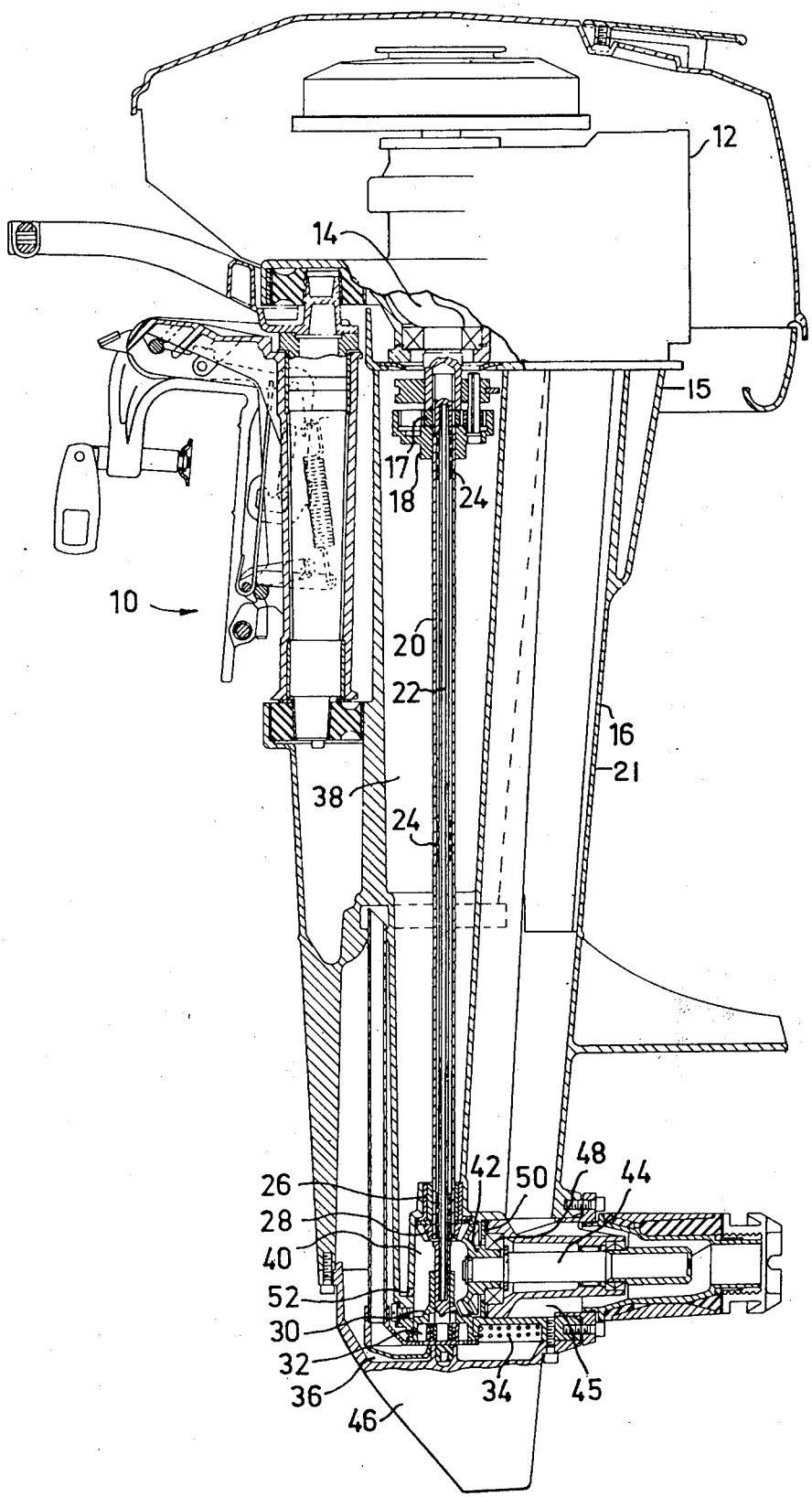

The present invention relates to a device for driving a propeller and cooling water pump with a motor via a reversible gear in the outboard drive housing.

The terms "outboard motor" and "outboard drive housing" are taken in what follows to mean not only the customary combination of a detachable motor with an outboard drive housing for driving a motor boat, but rather any combination where a fixed or detachable motor in a boat drives a propeller through an essentially downwardly directed leg, steering being effected by changing the axial direction of the propeller by pivoting the leg, and regardless of whether the motor is located inboard or outboard of the boat shell.

The device for driving the propeller and cooling water pump in an outboard motor normally comprises a so-called intermediate shaft which transmits the motor torque and power through the housing via a gear to the propeller shaft. In larger motors the gear is generally reversible in that either one forward or one rear conical gear wheel, freely rotatably journalled on the propeller shaft and engaging the angular drive of the intermediate shaft, is brought into operable engagement with the propeller shaft. This common type of reversing gear above the propeller shaft is bulky and entails a considerable broadening of the lower section of the housing which causes increased drag. In addition the propeller shaft prevents the placement of the cooling water pump at the most advantageous location, namely in the lower section of the housing below or in front of the propeller shaft. The reversing gear above the propeller shaft instead entails that the cooling water pump must be situated further up in the housing. There the pump is normally driven by the intermediate shaft to which the impeller is attached.

The arrangement of the cooling water pump in the housing above the reversing gear additionally implies that the housing must there be divided to allow assembly and inspection of the pump. This implies a complication in construction and greater inconvenience and expense in inspection and replacement of parts. In addition, the placement means that, to ensure cooling water supply under all operating conditions, the cooling water pump must operate with a greater suction head on the inlet side from a cooling water intake in the lower section of the housing. Since it is preferable to locate the cooling water inlet on the stern members of the housing because of the risk of blocking, the underpressure on the suction side is further increased when under way because of a hydrodynamic underpressure generally prevailing there.

The present invention is related to a device for powering a propeller and cooling water pump which is free from the abovementioned disadvantages and which permits placement of the cooling water pump at the bottom of the outboard drive housing where it is driven directly by an extension of the motor shaft and where the suction head to the pump is nil or negligible. The device according to the invention provides, in addition, good lubrication of all of the included drive components without the danger of water being mixed with the lubricating oil.

The invention also relates to a reversible gear in the form of a planetary gear for driving the propeller, the special design of this gear permitting power ahead with direct or reduced propeller speed, neutral position and power backwards with reduced propeller speed, while the cooling water pump is always driven directly by the crankshaft under all conditions.

According to the invention, the outboard drive housing is executed in a single piece by means of die-casting without the need for particular aftertreatment.

The characteristics of the invention are disclosed in the characterizing clause of the main claim.

The invention is described with reference to the enclosed drawings, in which

FIG. 1, partly in cross section, shows an outboard motor having a device for powering a propeller and cooling water pump according to one embodiment of the invention, and FIGS. 2 to 5 schematically show a suitable embodiment of a reversible planetary gear for the motor in various gear positions.

An outboard motor 10 is driven by a motor 12 attached at the upper end portion 15 of a housing 16, which motor has a motor drive shaft or crankshaft 14. On the crankshaft 14 there is externally mounted a gear 17 as the lead to a reversible gear 18 provided, for example, as a planetary gear. The gear 18 may, however, be any other reversible gear arrangement which allows a hollow intermediate shaft 20 for driving the propeller to be arranged coaxially outside a thinner shaft 22 from the crankshaft 14 for driving a cooling water impeller 32. The shafts 20 and 22 thus extend from the upper housing portion 15, through an intermediate portion 21 and into a lower propeller housing portion 45.

The pump shaft 22 is preferably made of hexagonal bar steel which is pressed into an end cavity in the crankshaft 14 and fixed there so that the linkage can transmit a torque.

A suitable connection can consist of an intermediate piece formed by sintering formed pressed metal powder, the top of which piece has a cavity for holding the intermediate piece on the end of the crankshaft and the bottom of which carries the gear ring to the sunwheel of the planetary gear, in addition to which there is a downwards facing, central, hexagonal cavity for holding the pump shaft 22.

The intermediate shaft 20 and the pump shaft 22 arranged rotatably therein together extend downwards through a cavity 38 in the drive housing 16. A bearing 26 for the shaft 20 is supported by wall members in the cavity 38 and by a cavity 40 facing upwards from the lower part of the drive housing. Under the bearing 26 and at the shaft 20 a gear 28 is mounted for transmitting the torque to a substantially horizontal propeller shaft 44 via a gear 42. The number of cogs in the gear wheels 28 and 42 is selected to provide an appropriate speed to the propeller shaft 44 under prevailing operating conditions. The wheels 28 and 42 may be produced using various known methods and from various known materials in various known shapes. To achieve low manufacturing costs and, at the same time, high reliability, it is preferable to produce the wheels by sintering pressed metal powder so that no chip-removing aftertreatment is required.

The pump shaft 22 extends through a center hole in the wheel 28, down through the cavity 40 and the upper section of a pump housing 30 to the impeller 32 to which the shaft 22 is non-rotatably joined. The impeller 32 and the housing 30 are sealed against one another.

From inlet holes 34, which are located in the stern section of the drive housing 16 or in a detachable mounted fin or dab 46 in its lower end cooling water is conveyed through a short inlet port to a pump inlet near the center of the impeller 32 to then flow out, with higher pressure, through an opposing pump outlet at the periphery of the impeller 32 to an outlet port 36.

As the figure shows the impeller 32 operates under rotation about the nearly vertical shaft 22 and is, in addition, open downwards towards the cover plate which delimits the discharge to the port 36.

This implies a considerable advantage compared with known arrangements in that the impeller 32 immediately ejects any abrasive particles accompanying the water through the intake holes 34 to the port 36. This substantially increases the operating life of the pump.

It will be apparent that the specific location of the pump housing 30 and impeller 32 in the lower propeller housing portion 45 may be otherwise than as described above, and it may be found advantageous to place the impeller forwardly of the axis of pump shaft 22 and to mount it on a horizontal shaft, typically coaxial with the propeller shaft 44, which impeller shaft would be driven directly from the pump shaft 22 by bevel gears located below the gear wheel 28 on the intermediate shaft.

The pump housing 30 and the impeller 32 can be made of metal but are preferably made of plastic or rubber.

An axial ball bearing 48 is provided astern of the wheel 42 against the wall in a propeller housing 45 for journalling the propeller shaft 44. The cavity 40 is sealed against the cavity 45 by means of a seal 50.

The cavities 38 and 40 thus form a chamber which is sealed for prevailing pressure against the cavity 45 and against the interior of the impeller 32. It is thereby possible for a suitable portion of this chamber to be used as a container for lubricating oil for lubricating all moving parts within the chamber, i.e. all parts outside of the motor 12 which require continuous lubrication. Shaft bearings 24 of plastic, for example, are provided outside the hexagonal shaft 22 at several locations along the length of the shaft for the circulation of oil and for oil supply to bearings and contact surfaces in the gear 18. Said shaft bearings on the inside of the pipe-shaped shaft 20 have one or more screw threads so constituted that in the interspace between the shaft 20 and the shaft 22 they pump a flow of oil to the upper end of the shaft 20, from which the oil is distributed to all of the movable parts of the gear 18 to then return the oil sump in the cavity 38. One or more openings 52 in the wall section between the cavities 38 and 40 returns the circulating oil to the lower end of the shaft 20.

Figure 2:
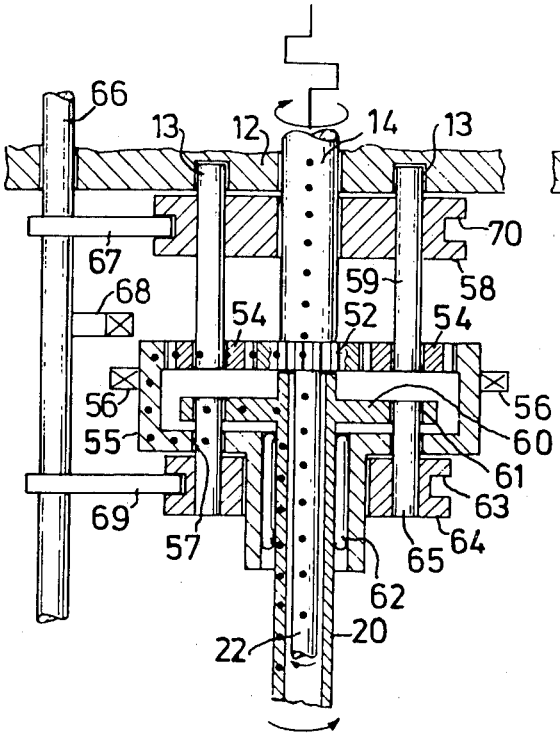

FIGS. 2 to 5 show various gear positions for driving the propeller shaft 44 by means of a suitable embodiment of the reversible gear 18. In FIG. 2 the crankshaft 14 extends downwards from the motor 12. At its lower end a so-called sunwheel 52 and the pump shaft 22 are attached. The sunwheel engages the cogs of planetary wheels 54 which are normally three in number and are symmetrically arranged on a planet wheel retainer (not shown) around the sunwheel. The planet wheels 54 in turn engage a peripherally arranged gear ring 55 comprising a downwards facing casing member, a bottom member furnished with blocking holes 57 and an inner, downward facing bearing member having a bearing 62 which surrounds the intermediate shaft 20 having the pump shaft 22 rotatably mounted therein. The casing member of the gear ring 55 has a number of outward facing teeth 56. At the upper end of the intermediate shaft 20 there is mounted an end plate 60 with holes 61 which can coincide with the blocking holes 57 in the gear ring 55.

Rotatably and slidingly arranged around the lower casing member of the gear wheel 55 is a coupling disc 64 having a peripheral groove 63 and upward facing pins 65 fixed in the disc, which pins can extend through both the holes 57 in the gear wheel 55 and through the holes 61 in the end plate 60.

Immediately below the front of the motor 12 there is arranged in a similar way — rotatably and slidingly about the crankshaft 14 — a second coupling disc 58 having a peripheral groove 70 and axial pins 59 whose upper part can be inserted into holes 13 in the motor 12 and whose lower part can be inserted into both the center holes of the planet wheels 54 and the holes 61 in the end plate 60.

The axial position of the coupling discs 58 and 64 is determined by the position of a gear shift bar 66 which is mounted slidingly and parallel to the crankshaft 14 and whose position is, in turn, determined by control means suitably connected to the gear selector, e.g. a shifting lever or a knob, on the motor. The gear shift bar 66 has three parallel projecting fingers 67, 68 and 69, of which the finger 67 slidingly projects into the groove 70 in the coupling disc 58 and the finger 69 in a similar way slidingly projects into the groove 63 in the disc 64. An axial displacement of the gear shift bar 66 thus causes a corresponding displacement of the discs 58 and 64 between an upper and a lower end position. The function of the finger 68 will be described below.

In the gear position shown in FIG. 2 the gear shift bar 66 is in its upper end position as are the coupling discs 58 and 64 and the respective coupling pins 59 and 65. The upper parts of the pins 59 project into the holes 13 in the motor block 12 while their lower parts project into the center holes of the planet wheels 54 and thus position them. At the same time the pins 65 are extended through the holes 57 in the gear wheel 55 and through the holes 61 in the end plate 60 of the intermediate shaft 20 so that the gear wheel 55 and the intermediate shaft 20 rotate together. The rotation of the crankshaft 14 is thus transmitted by the sunwheel 52 via the planet wheels 54 to reversed rotational direction of the gear wheel 55 under simultaneous speed reduction resulting from the ratio between the radius of the sunwheel and that of the gear wheel. The first gear position thus implies backward moving with lower propeller speed.

Figure 3:
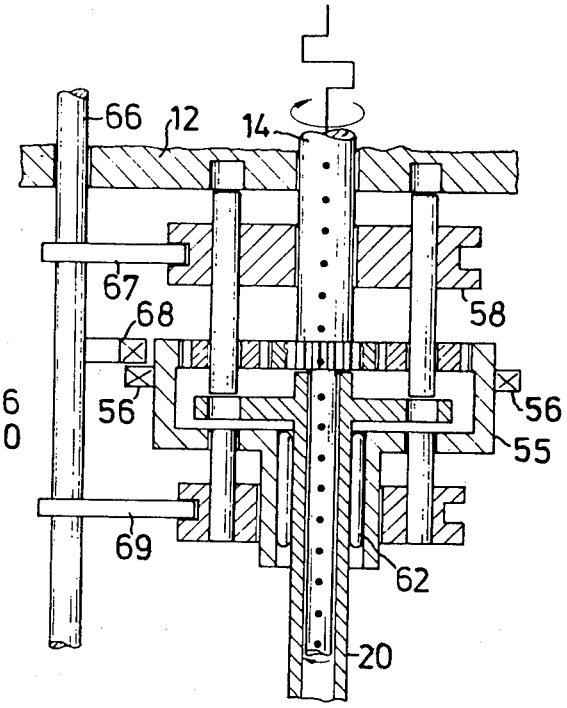

FIG. 3 shows a second gear position with the gear shift bar 66 depressed to the point where the upper part of the pins 59 is free from the holes 13 in the motor block 12, while the pins 65 of the coupling disc 64 are withdrawn from the holes 61 of the intermediate shaft 20 end plate 60. Since the end plate 60 is not connected to the sunwheel 52, the intermediate shaft 20 is not driven. Only the pump shaft 22 in the intermediate shaft 20 rotates. The second gear position is thus a neutral position.

Figure 4:
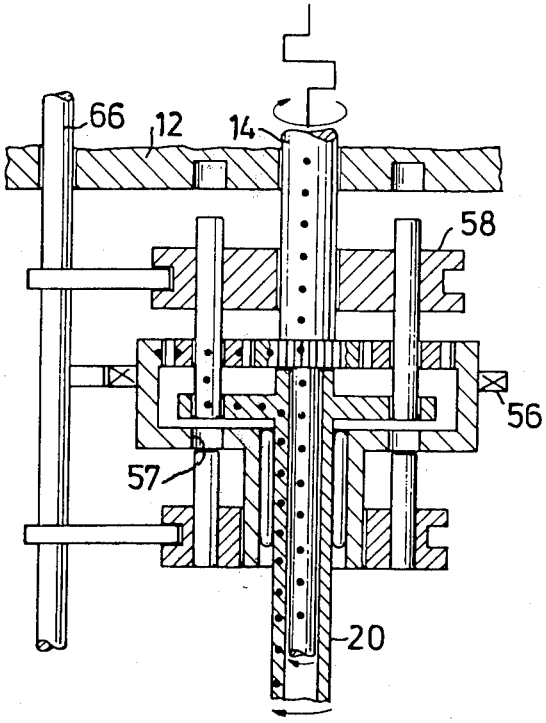

FIG. 4 shows a third gear position with the gear shift bar 66 depressed to the point where the lower parts of the pins 59 extend through both the center holes of the planet wheels 54 and through the holes 61 in the intermediate shaft 20 end plate 60. At the same time the second finger 68 of the gear shift bar 66 is in a position where it blocks the gear wheel 55 against rotation by engaging one or more outer teeth 56. It is presupposed that the finger 68 has necessary support for absorbing the moment from the gear wheel. At this point the rotation of the crankshaft 14 is transmitted by the sunwheel 52 to a similar, but reduced rotation of the centers of the planet wheels which, through the pins 59, carry the end plate 60 and the intermediate shaft 20. The third gear position thus provides power forward with reduced speed.

Figure 5:
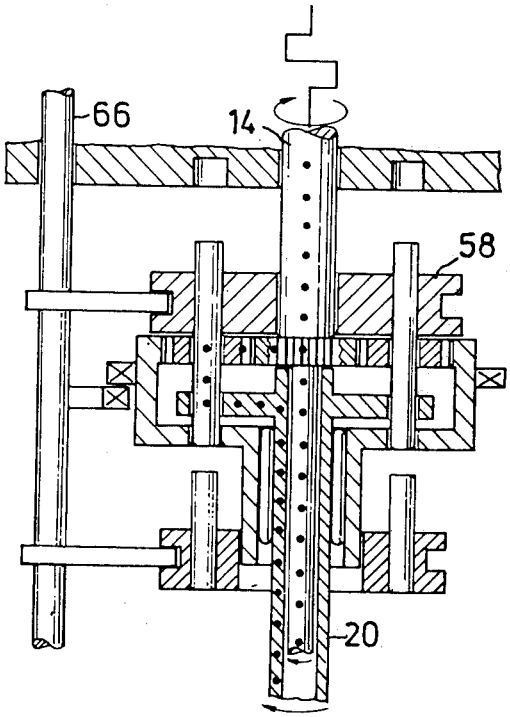

FIG. 5 shows a fourth gear position with the gear shift bar 66 in the lower end position, whereby the pins 59 of the coupling disc 58 extend through the center holes of the planet wheels 54 and through the holes 61 in the end plate 60 of the intermediate shaft 20 and the holes 57 of the gear wheel 55. At the same time, the finger 68 has released the blocking of the gear wheel 55. The pins 59 join the sunwheel 52 via the planet wheels 54 with the end plate 60 and the gear wheel 55 into a rigid unit. The fourth gear position thus provides direct driving forward.

What I claim is:

1. A power device for a propeller and a cooling water pump in an outboard motor comprising a crankshaft and an intermediate shaft for driving a propeller shaft, characterized in that between the crankshaft and the intermediate shaft is arranged a reversible gear device, in that the intermediate shaft is hollow and in that a pump shaft for powering a cooling water pump impeller is rigidly attached to the crankshaft and rotatably passes through the hollow intermediate shaft.

2. A power device according to claim 1, characterized in that shaft bearings are mounted on the pump shaft, which bearings have at least one screw thread against the inner side of the intermediate shaft for pumping lubricant from the lower end of the intermediate shaft to said gear device at its upper end when the shafts rotate relative to one another.

3. A power device according to claim 2, characterized in that the pump shaft has an uppermost end portion which is non-circular in cross section and said crankshaft is provided with a socket conforming in shape to and drivingly receiving said end portion of said pump shaft.

4. A power device according to claim 1, characterized in that the pump shaft has an uppermost end portion which is non-circular in cross section and said crankshaft is provided with a socket conforming in shape to and drivingly receiving said end portion of said pump shaft.

5. A power device according to claim 1 characterized in that said reversible gear device comprises a planetary gear outwardly of said pump and crank shafts.

6. A power device according to claim 5, wherein the planetary gear comprises a sunwheel mounted at the crankshaft and engaging planet wheels rotatably mounted thereabout which engage a gear wheel, the gear wheel comprising a downward facing, cylindrical casing member having outward facing teeth, a bottom member having blocking holes and a downward facing bearing member which is rotatable against the intermediate shaft, characterized in that an end plate having blocking holes is mounted at the upper end of the intermediate shaft between the bottom member of the gear wheel and the sunwheel, in that above the sunwheel and rotatably and slidingly about the crankshaft is arranged a first coupling disc having an outward facing groove and through axially parallel pins, whose upper sections can extend into holes in the motor block and whose lower sections can extend into center holes of the planet wheels and into the holes of the end plate and the blocking holes of the gear wheel, in that a second coupling disc is rotatably and slidingly arranged below the bottom member of the gear wheel, which disc has an outward facing groove and upward facing axially parallel pins which can extend both into the holes in the bottom member of the gear wheel and into the holes of the end plate, and in that, for determining the axial position of the pins, a gear shift bar having fingers which engage the grooves in the coupling discs is provided which, on displacement of the gear shift bar, displaces the pins through or out of the holes in the motor block, the center holes of the planet wheels, the holes in the end plate and the holes in the gear wheel to achieve the various gear positions.

7. A power device according to claim 1, characterized in that the cooling water pump impeller is located below the propeller shaft with downward facing inlet and outlet for the cooling water.

8. A power device according to claim 1, characterized in that the impeller is driven by an angular impeller drive gear wheel fixed on the pump shaft and disposed below a propeller drive gear wheel fixed on the lower end of the intermediate shaft, the impeller rotating substantially coaxially with the propeller shaft.

9. A power device according to claim 8, characterized in that the gear shift bar supports an additional finger which, in an additional gear position, blocks the teeth against the rotation of the gear wheel.

10. In an upright power leg for a boat drive comprising a housing including an upper end portion, an intermediate portion and a lower propeller housing portion, an intermediate shaft in said housing having an upper end and extending downwardly from its upper end through said intermediate portion and having a lower end disposed in said lower housing portion, a propeller shaft in said lower housing portion, gear means in said lower housing portion drivingly connecting said propeller shaft to said lower end of said intermediate shaft, a motor drive shaft in said upper end portion, and forward and reverse gear means in said housing connecting said drive shaft to said upper end of said intermediate shaft, the combination of a cooling water pump impeller disposed in said lower housing portion, and a pump shaft directly connected in said upper end portion to said motor drive shaft and extending through said intermediate portion of said housing and drivingly connected to said water pump impeller.

11. The combination according to claim 10 wherein said intermediate shaft is hollow and surrounds said pump shaft.

12. The combination according to claim 10, wherein said lower housing portion is provided with inlet and outlet passages extending downwardly from said impeller.

13. The combination according to claim 10 wherein said forward and reverse gear means comprises a planetary gear connecting exteriorly between said motor drive shaft and said upper end of said intermediate shaft, and said pump shaft projects upwardly from said upper end portion of said intermediate shaft.

14. The combination according to claim 10 wherein said pump shaft comprises an upper end portion which is non-circular in cross section and said motor drive shaft is provided with a socket conforming in shape to and drivingly receiving said non-circular upper end portion of said pump shaft.

15. The combination according to claim 10 wherein said lower housing portion comprises a portion which is removable to afford access to said impeller.

* * * * *